US006053622A

United States Patent [19]

Horowitz et al.

[11] Patent Number: 6,053,622

[45] Date of Patent: Apr. 25, 2000

[54] WAND ACTIVATED ELECTRONIC MENORAH

[75] Inventors: Victor Horowitz, Oceanside, N.Y.; James Boyd, Mendham, N.J.

[73] Assignee: Precision Controls, Inc., Oceanside, N.Y.

[21] Appl. No.: 08/972,726

[22] Filed: Nov. 18, 1997

[51] Int. Cl.[7] ..... F21V 23/04

[52] U.S. Cl. ..... 362/276; 3262/234; 3262/392; 3262/394; 3262/802

[58] Field of Search ..... 362/276, 251, 362/234, 392, 394, 800, 802, 810

[56] References Cited

U.S. PATENT DOCUMENTS

| | | | |
|---|---|---|---|
| D. 247,193 | 2/1978 | Maxwell | D48/2 |
| D. 291,922 | 9/1987 | Schaffer | D26/14 |
| D. 344,146 | 2/1994 | Wilton et al. | D26/13 |
| D. 351,786 | 10/1994 | Grunhut | D9/330 |
| 4,406,616 | 9/1983 | Greenvourcel | 431/295 |
| 4,492,896 | 1/1985 | Jullien | 362/810 X |
| 4,866,580 | 9/1989 | Blackerby | 362/800 X |
| 5,315,492 | 5/1994 | Davenport | 362/122 |
| 5,336,536 | 8/1994 | Oberzan | 428/8 |
| 5,405,662 | 4/1995 | Oberzan | 428/8 |

OTHER PUBLICATIONS

Martin C. Evans, "Celebration of Principles—Kwanzaa Tradition Grows," *Newsday,* Thursday, Dec. 26, 1996.

*Primary Examiner*—Stephen Husar
*Attorney, Agent, or Firm*—Kenyon & Kenyon

[57] ABSTRACT

An ornament, such as a menorah, is controlled by a microprocessor. The ornament has a LED circuit operably connected to a power supply circuit, and sensor capable of sending a signal to the microprocessor in response to external stimulus. The microprocessor controls whether a LED of the LED circuit emits light, and is capable of independently controlling a number of LEDs and responding to signals from a number of sensors.

40 Claims, 10 Drawing Sheets

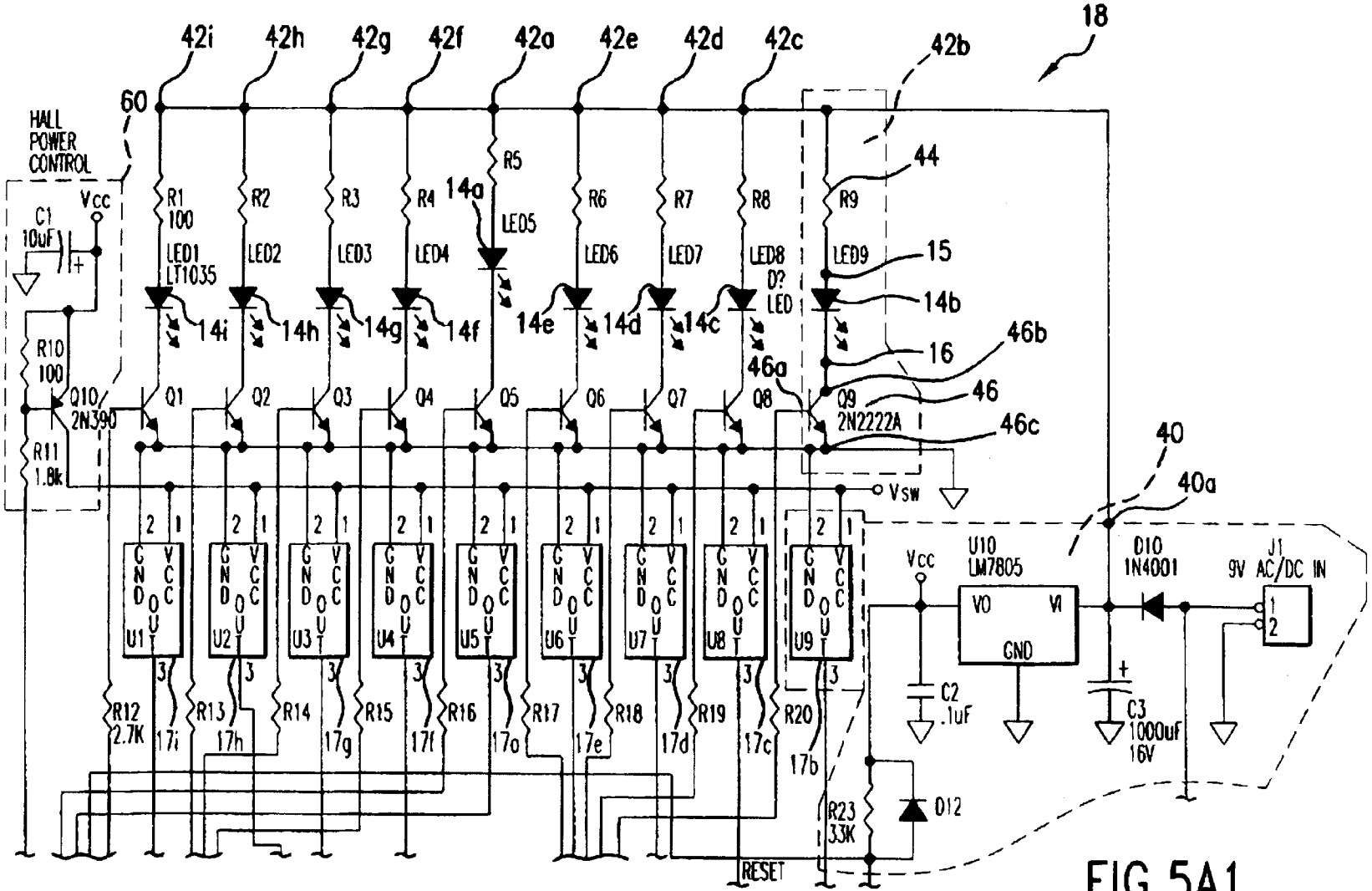
FIG.5A1

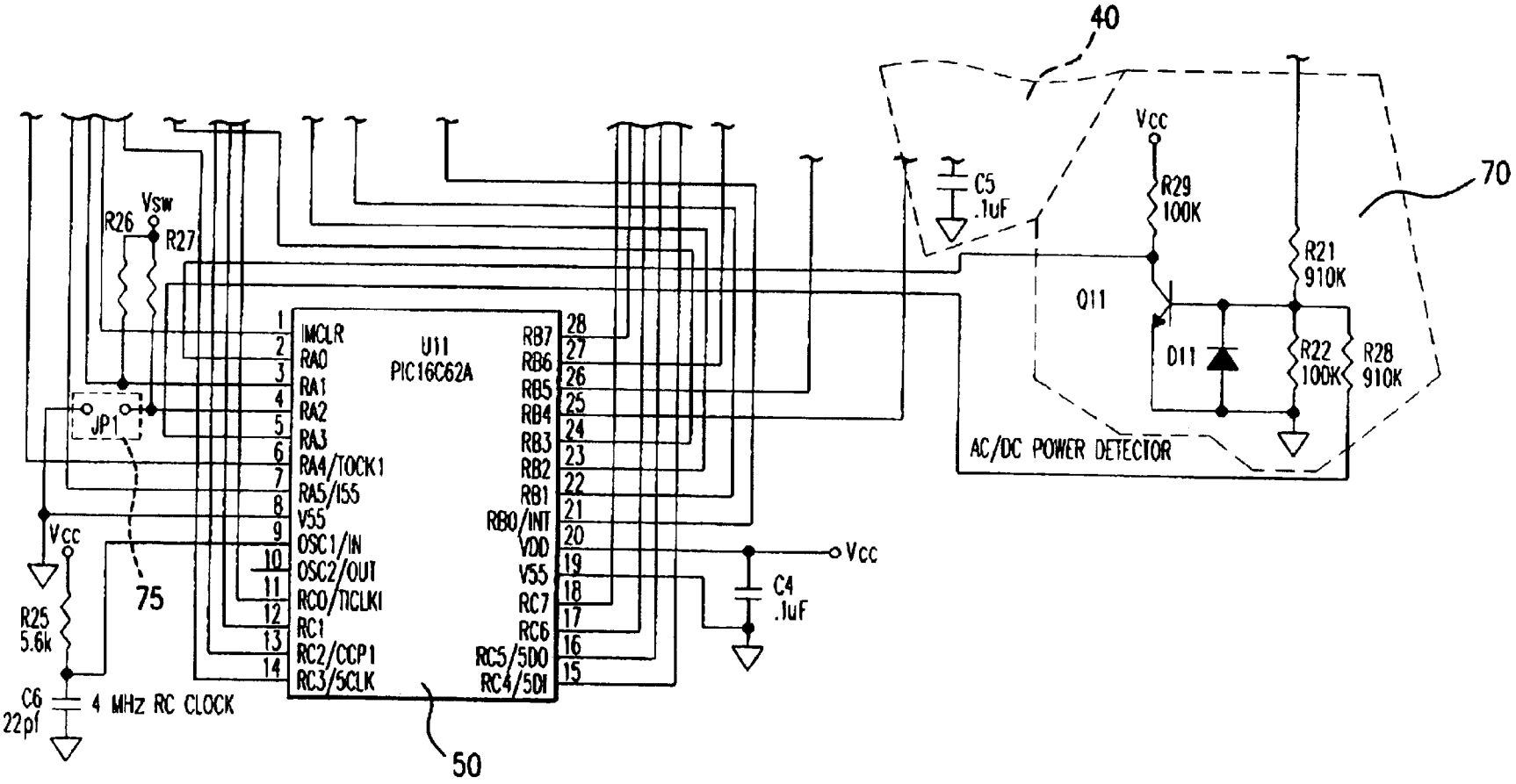
FIG.5A2

WAND ACTIVATED ELECTRONIC MENORAH

FIELD OF THE INVENTION

The present invention relates to an ornament having candle flames simulated by LEDs. More particularly, the present invention relates to a holiday ornament, such as a Chanuka menorah, where the simulated candle flames are controlled by a microprocessor.

BACKGROUND OF THE INVENTION

The menorah, designed to hold nine candles, plays a significant role in the Chanukah holiday. Each evening, a candle known as the "shamas" is first lit, which is then used to light the other candles in a sequential order in accordance with the number of days elapsed since the beginning of the holiday. Thus, on the first evening, the shamas is lit and used to light a single candle in the rightmost position on the menorah. On the second night, the shamas is lit and used to light the two rightmost candles, from left to right. In like fashion, all of the previously lit candles, as well as the next candle to the left of previously lit candles, are lit each evening, starting with the shamas and then proceeding from left to right, until the eight evenings of the holiday have elapsed. On the eighth evening, all nine positions on the menorah are occupied by burning candles. Each evening, all of the lit candles, including the shamas, are allowed to burn completely and are replaced for the next evening Thus, a total of 44 candles are required for the entire holiday.

Using real candles presents several disadvantages. Real candles may present a fire hazard, particularly if left unattended or if young children are present.

Menorahs with light bulbs instead of candles are known to the art. Typically, such menorahs are turned on and off by tightening and loosening the light bulbs in their sockets. However, light bulbs use a significant amount of electrical power, and frequently burn out. Moreover, tightening a light bulb in a socket lacks the ceremony that should attend the religious act of lighting a menorah.

U.S. Pat. No. 5,315,492 describes a menorah providing support for a plurality of artificial candles with LEDs providing artificial candle flames, However, only a single on/off switch is described, which does not allow for the sequential lighting of selected candles each evening.

A kinara is similar in appearance to a menorah, but has only seven candles. The kinara is featured in the Kwanzaa ceremony, which was conceived in 1966 and is based on a compilation of African festivals.

SUMMARY OF THE INVENTION

The present invention provides an ornament, such as a menorah or a kinara, having candle flames simulated by LEDs and controlled by electronic circuitry such that the tradition of lighting selected candles in sequential order each evening may be observed. The use of LEDs avoids the fire hazard, inconvenience and expense of real candles, as well as the power consumption and burn out associated with light bulbs.

The brightness, and hence the power consumption, of the LEDs may be controlled by a microprocessor by multiplexing across the multiple LEDs of the menorah and pulse-width modulation. Similarly, multiplexing and pulse-width modulation controlled by the microprocessor may be used to cause the LEDs to simulate the flicker of real candles, without the fire hazard and expense.

The microprocessor may also be programmed to switch off the LEDs after a predetermined period of time has elapsed. Timing the LEDs to switch off simulates the complete burning of real candles, and also saves power.

The menorah may be powered by battery or by AC power. A sensor may be employed to detect AC power, and the microprocessor may be programmed to disable power saving measures such as the switch-off timer when AC power is present.

The electronic circuitry may employ magnetic sensors to control the individual candles. The magnetic sensors are able to detect the proximity of a magnet, and send signals to the microprocessor or light the LEDs. The microprocessor may limit the order in which the candles may be lit.

The present invention may also include a low battery detect circuit, such that one or more LEDs flash when the battery is low, if a battery is used for power. This feature is particularly advantageous to users who, for religious reasons, are unable to change batteries during certain time periods, and therefore may need to know that the battery is running low before a battery change is required.

The present invention may also employ a removable shamas with an LED instead of a magnet, and photo sensors instead of magnetic sensors, such that the other LED simulated candles can be turned on by proximity to the LED on the shamas. The shamas may have a separate power supply, possibly rechargeable, so that its LED can remain lit while it is being used to turn on the other LED simulated candles.

The present invention may also be used to provide any other ornament with individually lightable candles simulated by LEDs, such as an advent wreath.

The present invention provides an ornament, configured to represent a selected series of candle flames, comprising: a power supply circuit; a plurality of LED circuits, each LED circuit further comprising: a LED adapted to represent a flame operably connected to said power supply circuit; and a sensor operably connected to said LED capable receiving external stimulus from a user and controlling whether said LED emits light in response to said external stimulus, wherein each sensor is operable independently from sensors in other LED circuits.

The present invention further provides an ornament, comprising: a power supply circuit; a LED circuit operably connected to said power supply circuit and having a LED; a sensor operably connected to said power supply circuit and capable of sending a first signal in response to external stimulus; and a microprocessor, operably connected to said sensor and capable of receiving said first signal, and operably connected to said LED circuit and capable of controlling whether said LED of said LED circuit emits light.

BRIEF DESCRIPTION OF THE DRAWINGS

FIG. 5A1 and FIG. 5A2 show a circuit diagram of an embodiment of the present invention including a microprocessor.

DETAILED DESCRIPTION

The present invention will be described with reference to the illustrative embodiments in the following drawing figures.

Figure 1:
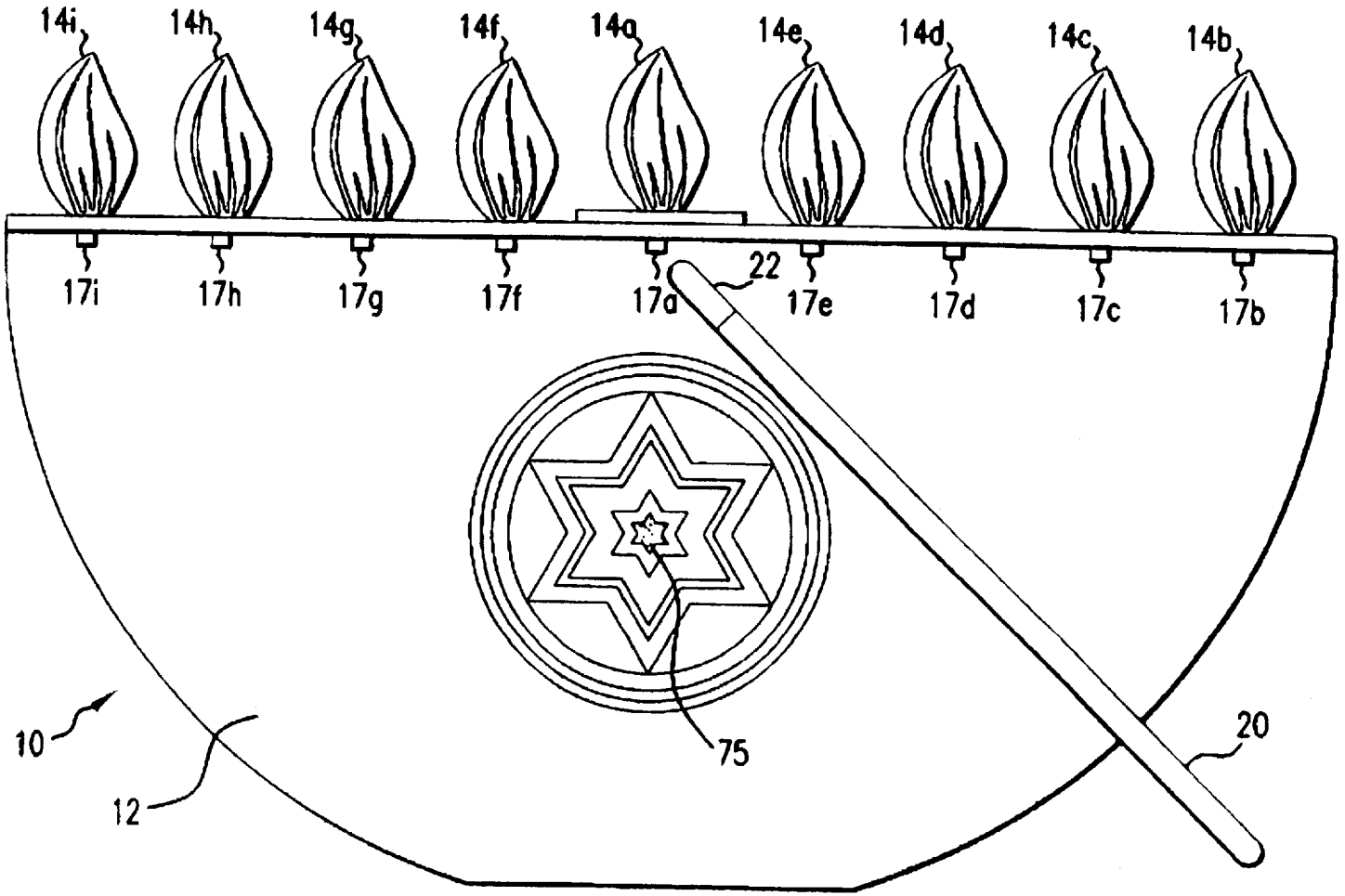
FIG. 1 shows a frontal view of an embodiment of the present invention.

FIG. 1 shows a frontal view of a menorah 10. A base 12 supports LEDs 14, including LEDs 14*a*, 14*b*, 14*c*, 14*d*, 14*e*, 14*f*, 14*g*, 14*h*, and 14*i*. Base 12 also houses electronic circuitry 18 (not shown in FIG. 1), and sensors 17, which include sensors 17*a*, 17*b*, 17*c*, 17*d*, 17*e*, 17*f*, 17*g*, 17*h* and 17*i*, as well as user input circuit 75. FIG. 1 also shows a wand 20 with a magnet 22 held in proximity to sensor 17*a*.

Figure 2:
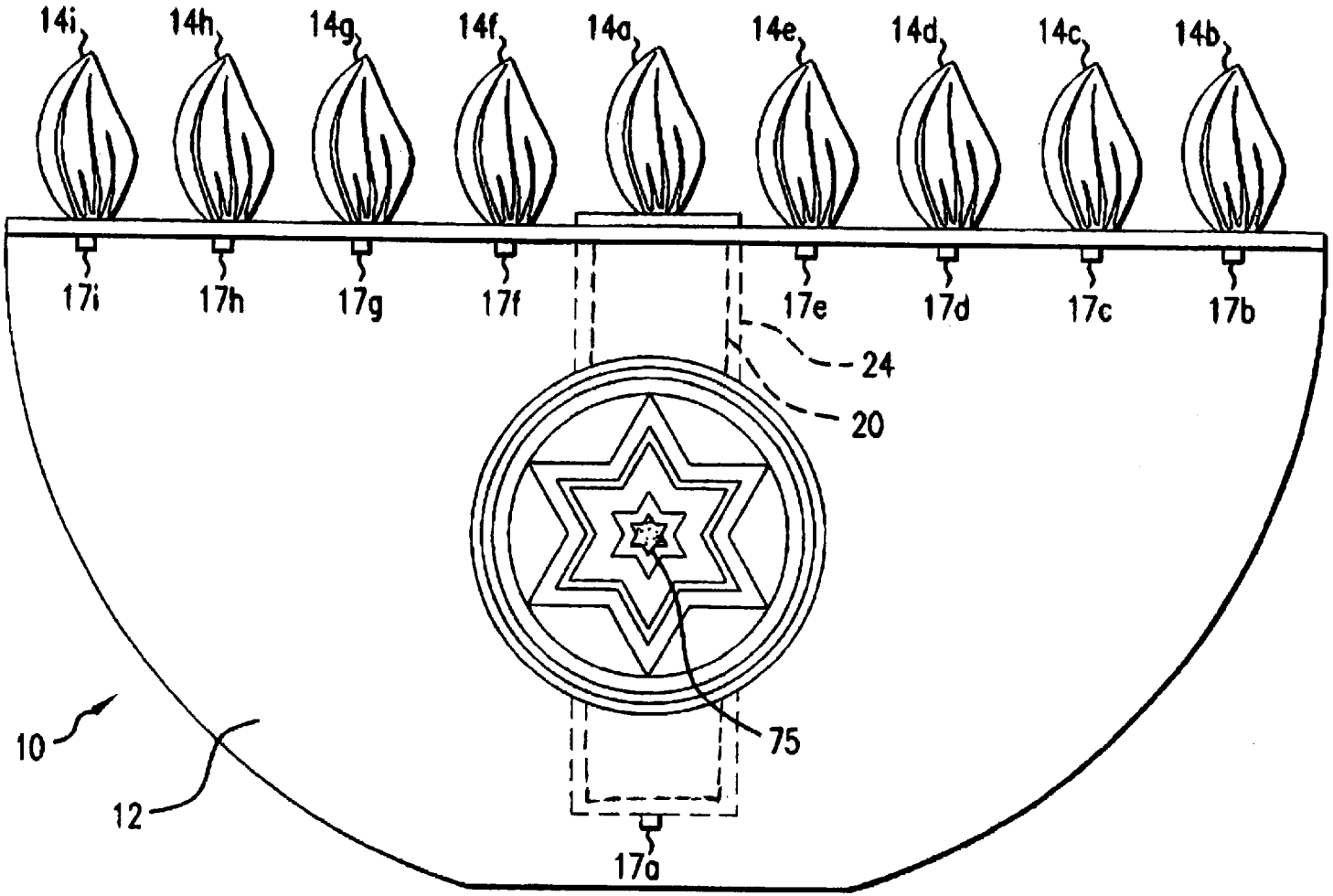
FIG. 2 shows a frontal view of an embodiment of the present invention including a recess and a removable wand.

FIG. 2 shows a frontal view of another embodiment of menorah 10. In this embodiment, LED 14*a* may be mounted on wand 20, and wand 20 is removable from a recess 24 in base 12 of menorah 10. Sensor 17*a* remains within menorah 10 when wand 20 is removed. LEDs 14*b* through 14*i*, sensors 17*b* through 17*i*, and user input circuit 75 appear as in FIG. 1. In this embodiment, wand 20 with LED 14*a* represents the shamas, and the eight LEDs 14*b* through 14*i* of menorah 10 represent the other eight candles of a traditional menorah.

Figure 3:
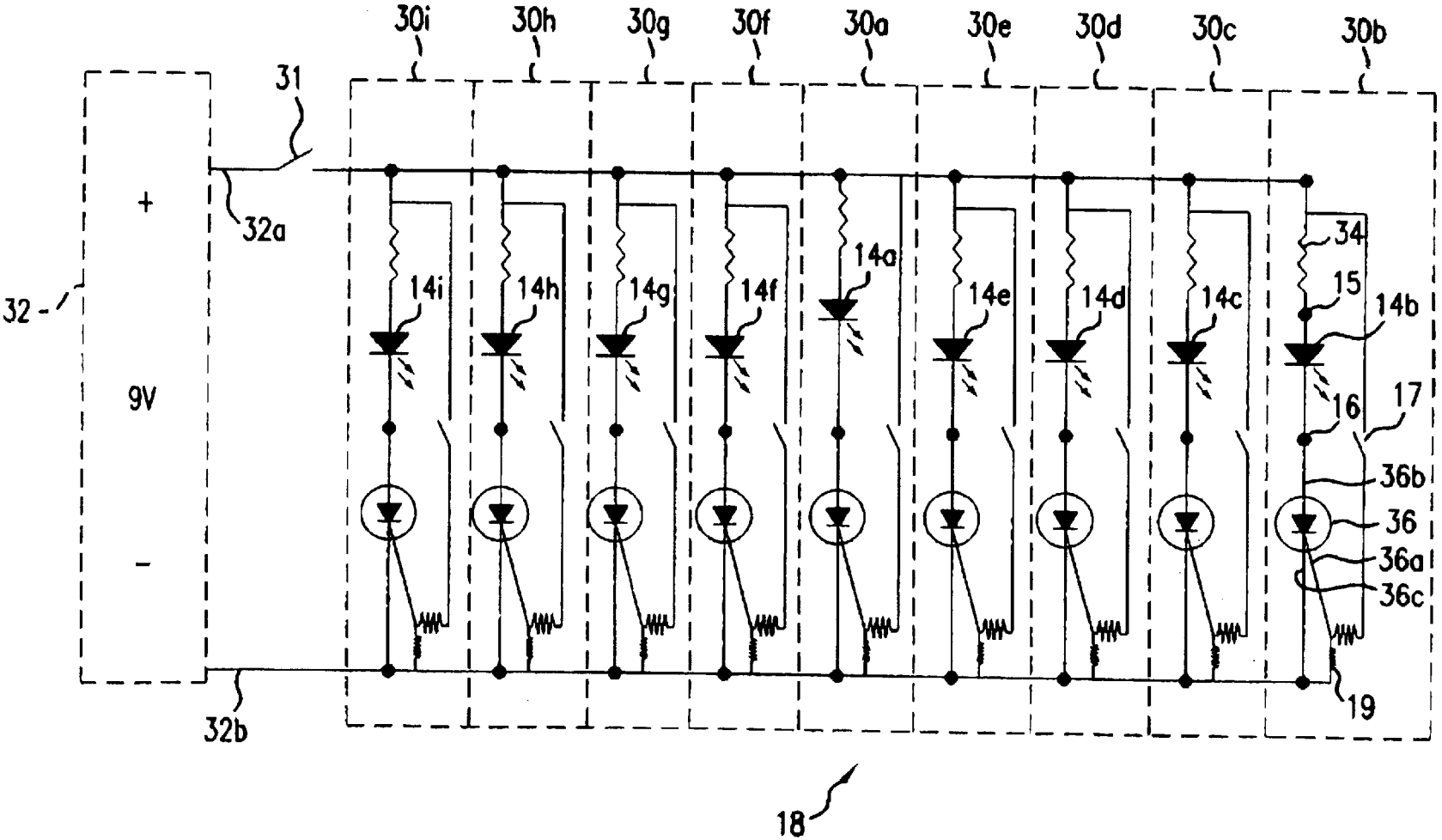
FIG. 3 shows a circuit diagram of an embodiment of the present invention including a thyristor.

FIG. 3 shows an embodiment of electronic circuitry 18. Nine identical LED circuits 30, including LED circuits 30*a*, 30*b*, 30*c*, 30*d*, 30*e*, 30*f*, 30*g*, 30*h* and 30*i*, each having a corresponding LED 14, i.e. LEDs 14*a*, 14*b*, 14*c*, 14*d*, 14*e*, 14*f*, 14*g*, 14*h* and 14*i*, are operably connected in parallel to a power supply circuit 32 having a positive node 32*a* and a negative node 32*b*. A user input circuit 31 is operably connected between positive node 32*a* and LED circuits 30. A power source, such as a nine volt battery, may supply power to power supply circuit 32. Each LED circuit 30 comprises a resistor 34, a LED 14 having an anode 15 and a cathode 16, a sensor 17, a termination resistor 19, and a thyristor 36 having a gate 36*a*, a anode 36*b*, and an cathode 36*c*. Resistor 34 is operably connected to positive node 32*a* and to anode 15 of LED 14. Cathode 16 of LED 14 is operably connected to anode 36*b* of thyristor 36, and cathode 36*c* of thyristor 36 is operably connected to negative node 32*b* of power supply circuit 32. A sensor 17 and a resistor 38 are operably connected in series between positive node 32*a* and gate 36*a* of thyristor 36. Termination resistor 19 is operably connected between gate 36*a* of thyristor 36 and negative node 32*b* of power supply circuit 32, to prevent false triggering of thyristor 36. In this embodiment, sensor 17 is a magnetic switch that is closed when in proximity to magnet 22, and is otherwise open.

Each LED circuit 30 operates in the following manner. Initially, sensor 17 is open, thyristor 36 does not permit current to flow from anode 36*b* to cathode 36*c*, and LED 14 does not emit light. A user then places magnet 22 in proximity to sensor 17, causing the magnetic switch to close, and a gate voltage is applied to gate 36*a* of thyristor 36. Thyristor 36 will now permit current to flow from anode 36*b* to cathode 36*c*. As a result, current flows from positive node 32*a* through resistor 34, LED 14, and thyristor 36 to negative node 32*b*, and LED 14 emits light. Even after the user removes magnet 22 from proximity to sensor 17 such that the magnetic switch opens and a gate voltage is no longer applied to gate 36*a*, the current flowing through thyristor 36 provides an internal positive feedback such that thyristor 36 "latches on" and continues to allow current to pass, and LED 14 remains lit. Each of the LED circuits 30 operates in a similar manner, such that the user may separately light each LED 14 by placing magnet 22 in proximity to the corresponding sensor 17.

User input circuit 31 is a switch that is closed by default, allowing current to pass, but that opens in response to a stimulus from a user. For example, user input circuit 31 may be a magnetic switch that is closed by default, but opens when in proximity to magnet 22. Because user input circuit 31 is closed by default, sensors 17 may be used to light LEDs 14, which will remain lit. However, when user input circuit 31 is opened by an external stimulus, the flow of current through thyristors 36 is interrupted, causing thyristors 36 to "unlatch," and returning all LED circuits 30 to their initial state, i.e., current does not flow and LEDs 14 are not lit. After user input circuit 31 returns to its default closed status sensors 17, thyristors 36 remain unlatched until a gate voltage is applied to gate 36*a* by closing sensor 17.

Figure 4:
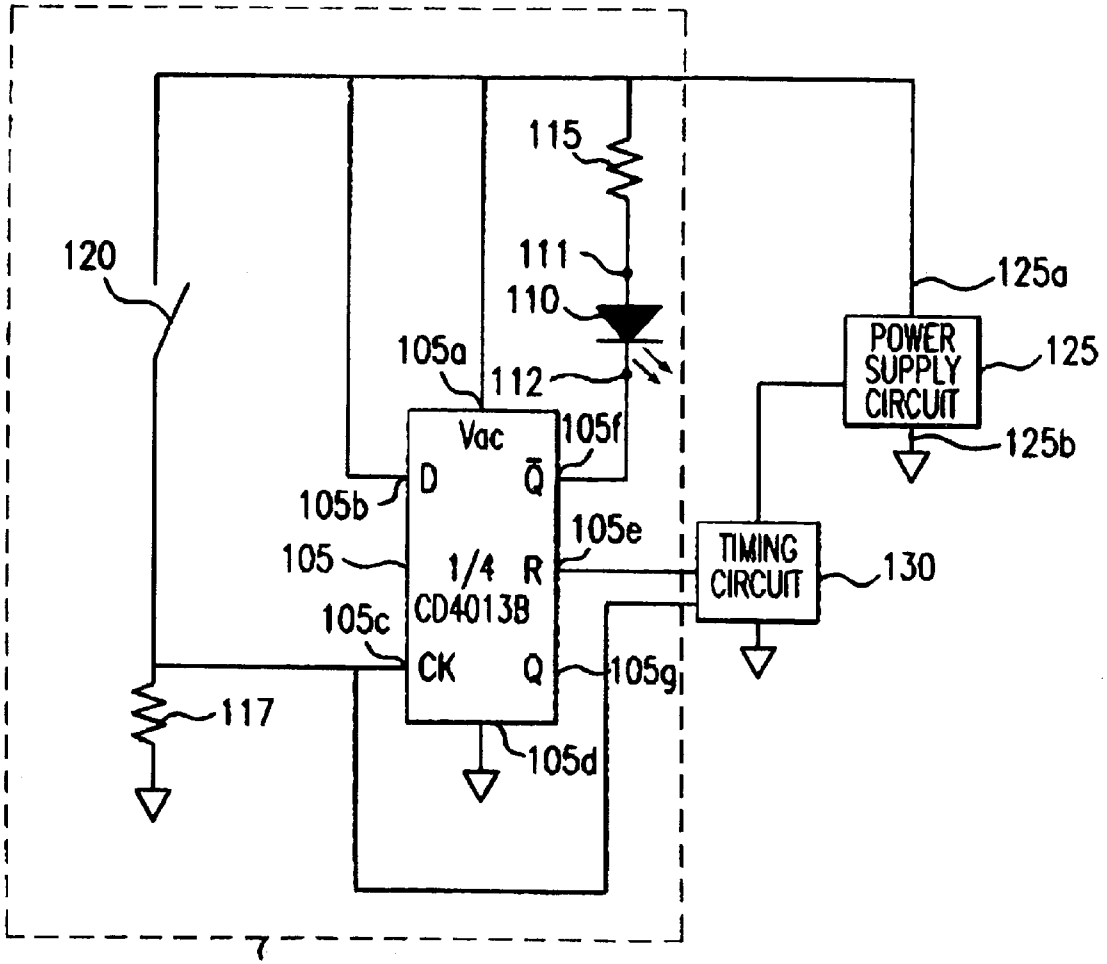
FIG. 4 shows a circuit diagram of an embodiment of the present invention including a logic device.
Figure 6:
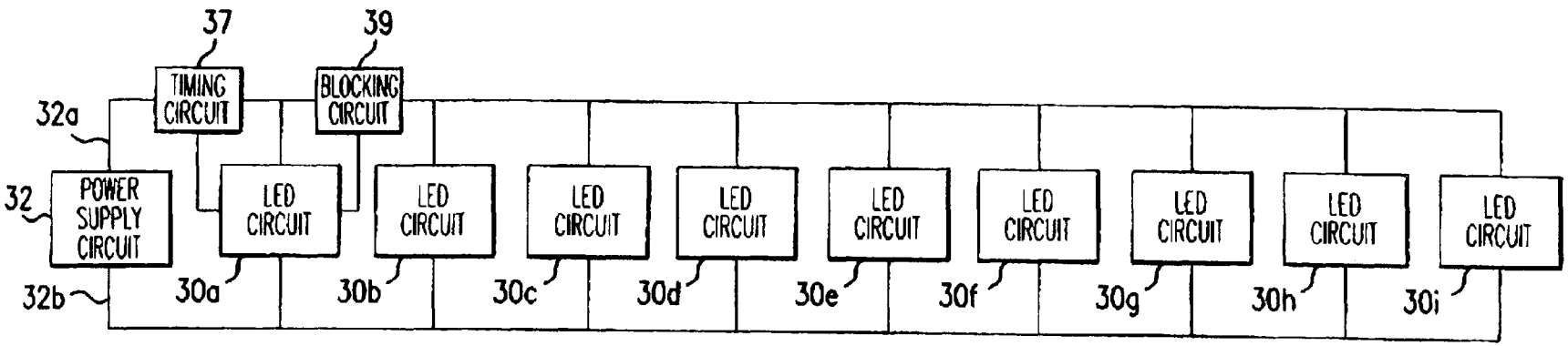
FIG. 6 shows a system level diagram of an embodiment of the present invention including a timing circuit and a blocking circuit.

FIG. 4 shows an embodiment of a LED circuit 100 having a logic device 105, such as the D-flip-flop shown in FIG. 4. Logic device 105 has a power input 105*a*, a voltage input 105*b*, a clock input 105*c*, a ground connection 105*d*, a reset input 105*e* and a voltage output 105*f*. Depending upon the particular type of logic device 105 used, there may be one or more unused input or output connections 105*g*. LED circuit 100 comprises logic device 105, a LED 110 having an anode 111 and a cathode 112, resistors 115 and 117, and sensor 120. LED circuit 100 is operably connected to a power supply circuit 125 having a positive node 125*a* and a negative node 125*b*. A power source, such as a nine volt battery, may supply power to power supply circuit 125. LED circuit 100 may also be connected to a timing circuit 130. A plurality of LED circuits 100 may be operably connected in parallel to power supply circuit 125, in a manner similar to the manner that several LED circuits 30 are connected to power supply circuit 32 as shown in FIG. 6.

Resistor 115 is operably connected to positive node 125*a* and to anode 111 of LED 110. Cathode 112 of LED 110 is operably connected to voltage output 105*f* of logic device 105. Power input 105*a* and voltage input 105*b* of logic device 105 are also operable connected to positive node 125*a*. Sensor 120 is operably connected between positive node 125*a* and clock input 105*c* of logic device 105. Resistor 117 is operably connected between clock input 105*c* and negative node 125*b*. Ground connection 105*d* of logic device 105 is operably connected to negative node 125*b*. A timing circuit 130 is operably connected to positive node 125*a* and 125*b*, and is also operably connected to reset input 105*e* of logic device 105. Timing circuit 130 may also be operably connected to clock input 105*c*, or may be adapted to receive stimulus from a source other than LED circuit 100.

LED circuit 100 operates in the following manner. Upon power up, timing circuit 130 applies a reset signal to reset input 105*e* causing voltage output 105*f* to rise to a logic HIGH voltage approximately equal to the voltage at power input 105*a* and positive node 125*a*, sensor 120 is open, and no voltage is applied to clock input 105. Because the voltage at positive node 125*a* and voltage output 105*f* are approximately the same, no current flows through LED 110. A user then interacts with sensor 120, for example by placing magnet 22 in proximity to sensor 120 if sensor 120 is a magnetic switch, causing sensor 120 to close, and causing a voltage to be applied to clock input 105*c* of logic device 105.

The same voltage may also be applied to timing circuit 130 at this time. The voltage applied at clock input 105*c* causes the logical complement of the voltage at voltage input 105*b* to be transferred to voltage output 105*f*, i.e., the voltage at voltage output 105*f* is a logic LOW voltage of approximately zero because the voltage at voltage input 105*b* is a logic HIGH voltage approximately equal to the voltage at power input 105*a*. Because there is a voltage difference between positive node 125*a* and voltage output 105*f*, current flows from positive node 125*a* through resistor 115 and LED 110 to voltage output 105*f*, causing LED 110 to emit light. LED 110 continues to emit light until timing circuit 130 applies a voltage to reset input 105*e* of logic device 105, at which time logic device 105 is set to its initial state, i.e., voltage output 105*f* is set to a logic HIGH voltage approximately equal to the voltage at power input 105*a* and positive node 125*a*, and current no longer flows through LED 110. Timing circuit 130 may apply a voltage to reset input 105*e* after a predetermined period of time has elapsed from the time a voltage was applied to clock input 105*c* and timing circuit 130, or in response to an external stimulus.

FIGS. 5A1 and FIG. 5A2 show another embodiment of electronic circuitry 18. A power supply circuit 40 supplies regulated 5V voltage between VCC and ground, as well as 9V DC between positive node 40*a* and ground. Power supply circuit may be adaptable to receive power from different sources, such as a nine volt battery or a wall outlet. LED circuits 42 include LED circuits 42*a*, 42*b*, 42*c*, 42*d*, 42*e*, 42*f*, 42*g*, 42*h* and 42*i*, and each LED circuit 42 includes a corresponding LED 14, i.e. LEDs 14*a*, 14*b*, 14*c*, 14*d*, 14*e*, 14*f*, 14*g*, 14*h* and 14*i*, respectively. Each LED circuit 42 also includes a resistor 44 and a transistor 46. Resistor 44 is operably connected to positive node 40*a* and an anode 15 of LED 14. Cathode 16 of LED 14 is operably connected to collector 46*b* of transistor 46. Emitter 46*c* of transistor 46 is operably connected to ground. If voltage is not applied to base 46*a* of transistor 46, transistor 46 blocks the flow of current through resistor 44 and LED 14. If voltage is applied to base 46*a*, current flows from positive node 40*a* through resistor 44, LED 14 and transistor 46 to ground, causing LED 14 to emit light.

In this embodiment, sensors 17, including sensors 17*a*, 17*b*, 17*c*, 17*d*, 17*e*, 17*f*, 17*g*, 17*h* and 17*i*, which correspond to LEDs 14*a*, 14*b*, 14*c*, 14*d*, 14*e*, 14*f*, 14*g*, 14*h* and 14*i* respectively, are Hall-effect sensors operably connected to microprocessor 50, such that sensor 17 sends a signal to a microprocessor 50 when magnet 22 is held in proximity to sensor 17. Microprocessor 50 is a programmable microprocessor operably connected to each sensor 17 and to each LED circuit 42, and capable of receiving input from each sensor 17 and applying a voltage to base 46*a* of each transistor 46 in each LED circuit 42, and thereby controlling whether each LED 14 of each LED circuit 42 is lit. Moreover, by controlling the length of time that voltage is applied to each base 46*a*, microprocessor 50 is capable of controlling the brightness of each LED 14. In one embodiment, microprocessor 50 is a PIC16C62A, a one-time programmable chip, available from Microchip located in Chandler, Ariz.

A Hall power controller 60 is operably connected between VCC of power supply circuit 40 and sensors 17. Hall power controller 60 is also operably connected to microprocessor 50. Hall power controller responds to input from microprocessor 50 such that power is provided to sensors 17 only at predetermined intervals, during which microprocessor 50 scans sensors 17 for signals. In one embodiment, power is provided to sensors 17 every eighth of a second for approximately 50–120 microseconds, or just long enough for the output of sensors 17 to stabilize and for microprocessor 50 to read any signals sent by sensors 17. Not providing power to sensors 17 for the remainder of each eighth of a second significantly reduces the power consumption of electronic circuitry 18.

Microprocessor 50 may be programmed in a number of ways to light LEDs 14 in response to signals from sensors 17. Preferably, microprocessor 50 turns a LED 14 on in response to a signal from the sensor 17 corresponding to the particular LED 14, and continues to leave LED 14 on even after sensor 17 ceases sending a signal, i.e., after magnet 22 is removed from proximity to sensor 17.

Once a particular LED 14 has been turned "on," microprocessor 50 may control the power consumption, brightness and flicker of that LED 14 by allowing current to flow through LED 14 only a fraction of the time. Preferably, microprocessor 50 is programmed to multiplex the current flowing through LED 14. After microprocessor 50 has received a signal from a particular sensor 17 such that the corresponding LED 14 should be on, microprocessor 50 may allow current to flow through the corresponding LED 14 only a fraction of the time. Preferably, current flows though only one LED 14 at any point in time. By rapidly changing which LED 14 through which current is flowing, it appears to the user as if all lit LEDs 14 remain lit. Multiplexing reduces power consumption, and, if the multiplexing cycle is quick enough, is not visible to the user. In one embodiment, each LED circuit 14 is allocated one millisecond in a nine millisecond cycle. Microprocessor 50 allows current to flow through a particular LED 14 that is "on" only during the allocated millisecond.

Microprocessor 50 may also be programmed to control the brightness of LEDs 14 by controlling the length of time that current is allowed to flow through a LED 14. In one embodiment, the millisecond allocated to a LED 14 is further subdivided into 250 time slots, each one four microseconds long. By allowing current to flow through LED 14 for only a fraction of these time slots, microprocessor 50 can control the brightness of LEDs 14. Preferably, microprocessor 50 is programmed such that it increases the brightness of a particular LED 14 over a period of time after it has been turned on. Increasing the brightness over a period of time simulates the way a candle flame grows from a small flame to a large flame when the candle is lit.

Microprocessor 50 may also be programmed to cause LEDs 14 to simulate the flicker of a real candle flame by varying the brightness of LEDs 14. In one embodiment, microprocessor 50 may allow current to flow through each LED 14 that is on for between about 120 and 1000 microseconds during the millisecond allocated to the particular LED 14. The flicker variation, i.e. the variation between 120 and 1000 microseconds, preferably occurs at a rate that is visible to a human user, i.e., 5–20 Hertz. A more realistic effect may be obtained by providing each LED 14 with an individualized flicker variation.

Microprocessor 50 may also enforce a particular order of lighting for LEDs 14. Preferably, microprocessor 50 is programmed to not light a particular LED 14 in response to a signal from the corresponding sensor 17 unless the LED in question is LED 14*a*, or unless LED 14*a* has already been lit. LED 14*a* corresponds to the shamas of a traditional menorah with candles, which traditionally must be lit first. As shown in FIG. 1, LED 14*a* is the shamas because it is elevated slightly above the other LEDs 14, and is the center LED 14. Note that LED 14*a*, the shamas, need not be the center LED 14 nor elevated above the other LEDs 14 as shown in FIG. 1, so long as LED 14*a* is set apart from the other LEDs 14 in some manner. Microprocessor 50 may also be programmed to enforce the entire traditional sequence of lighting candles in a traditional menorah, i.e., microprocessor 50 will not light a particular LED 14 in response to a signal from the corresponding sensor 17 unless LEDs 14 are lit in the order 14*a,* then an LED 14 other than LED 14*a,* and then LEDs 14 to the left of the previously lit LED 14, in order from left to right. If microprocessor 50 does not keep track of how many days of the holiday have elapsed, microprocessor 50 may rely on input from the user, i.e., the user has discretion to choose which LED 14 is lit immediately after LED 14*a*. The requirements that microprocessor 50 puts on the order of the lighting of LEDs 14 may vary according to the intended user of menorah 10. For example, if a young child is to use menorah 10, it may be preferable to require only that LED 14*a* is lit first.

Preferably, microprocessor 50 is programmed to automatically turn off all LEDs 14 after a period of time, such as 2 hours, has expired. This automatic turn-off conserves power, and also simulates the complete burning of real candles. Preferably, microprocessor 50 is also programmed to turn off all LEDs 14 in response to a particular set of stimuli from sensors 17, such as two separate signals from sensor 17*a* within a set period of time, such as approximately 15 seconds. Microprocessor 50 may be programmed to ramp the brightness of LEDs 14 down slowly, to simulate the burning out of a real candle, or to reduce the brightness of LEDs 14 quickly, to simulate the blowing out of a real candle.

Preferably, microprocessor 50 is also operably connected to and capable of receiving input from an AC/DC power detector 70. By interpreting the signal from AC/DC power detector 70, microprocessor 50 can determine when power supply circuit 40 is powered by a DC source such as a battery, and when power supply circuit 40 is powered by an AC source such as an external AC power pack. Microprocessor 50 may be programmed such that power saving features, such as automatic turn-off, are in effect when power supply circuit 40 is powered by a battery, which may otherwise be rapidly drained by excessive power consumption, but are not in effect when power supply circuit 40 is powered by an AC source because the power requirements of the present invention will not significantly drain typical AC power sources, such as power from a wall outlet.

User input circuit 75 allows a manufacturer or a user to provide additional input to microprocessor 50. As shown in FIG. 3, user input circuit 75 is a jumper that allows a manufacturer or a user to select between alternative programs for microprocessor 50. For example, simulated candle flicker or enforcement of the traditional order of lighting may be enabled or disabled by user input circuit 75. In a different embodiment, user input circuit is a mechanical switch that sends a signal to microprocessor 50 when closed. In another embodiment, user input circuit 75 is a Hall-effect sensor, operably connected to microprocessor 50, that sends a signal to microprocessor 50 when in proximity to magnet 22. Microprocessor 50 may respond to a signal from user input circuit 75 by turning off all LEDs 14, for example.

In an alternative embodiment, the present invention may be implemented using any type of sensor 17 capable of receiving input from a user. For example, sensors 17 may be mechanical switches, capacitive switches or touch plates. If LED 14*a* is mounted on wand 20, as shown in FIG. 2, sensors 17*b* through 17*i* are preferably photo sensors that send a signal to microprocessor 50 when in proximity to LED 14*a*. Photo sensors and LEDs are generally preferred over Hall-effect sensors and magnets due to cost consideration.

FIG. 6 shows a system level diagram of an embodiment of the present invention. Nine LED circuits 30, including LED circuits 30*a,* 30*b,* 30*c,* 30*d,* 30*e,* 30*f,* 30*g,* 30*h* and 30*i,* each having a LED, are operably connected in parallel to a power supply circuit 32 having a positive node 32*a* and a negative node 32*b,* i.e., each LED circuit 30 is operably connected to positive node 32*a* and negative node 32*b*. A power source, such as a nine volt battery, may supply power to power supply circuit 32. Each LED circuit 30 operates in a manner similar to LED circuits 30 of FIG. 3, i.e., with reference to FIG. 3, LED 14 of each LED circuit 30 remains off until an external stimulus is applied to a sensor 17, at which time LED 14 of that particular LED circuit 30 is turned on and remains on even after the external stimulus is removed. Additionally, LED circuit 30*a* is capable of sending signals to a timing circuit 37 and to a blocking circuit 39 that are different depending upon whether or not LED circuit 30*a* has been turned on.

Timing circuit 37 is operably connected to positive node 32*a,* and to each LED circuits 30, such that timing circuit 37 interrupts the connection between power supply circuit 32 and LED circuits 30. Timing circuit 37 is also operably connected to LED 30*a*. Initially, timing circuit 37 allows current to flow freely, although no current should flow until one or more LEDs 30 are turned on. When LED circuit 30*a* is turned on, LED circuit 30*a* sends a signal to timing circuit 37. After receiving this signal, timing circuit 37 continues to allow current to flow freely for a predetermined period of time, and then interrupts the flow of current to LED circuits 30 from power supply circuit 32. After a period of time sufficient to ensure that all LED circuits 30 are off, timing circuit 37 again allows current to flow freely, although at this point all LED circuits 30 should be off such that no current flows. Timing circuit 37 operates such that all LED circuits 30 will be automatically turned off a predetermined period of time after LED circuit 30*a* is lit.

Blocking circuit 39 is operably connected to positive node 32*a* of power supply circuit 32, such that blocking circuit 39 interrupts the connection between positive node 32*a,* via timing circuit 37, and LED circuits 30*b*–30*i,* but not LED circuit 30*a*. Blocking circuit 39 is also operably connected to LED circuit 30*a*. Blocking circuit 39 does not allow current to pass unless it is receiving a signal from LED 30*a* indicating that LED 30*a* is on. This ensures that LED circuits 30*b*–30*i* can not be turned on unless LED circuit 30*a* is on.

Figure 7:
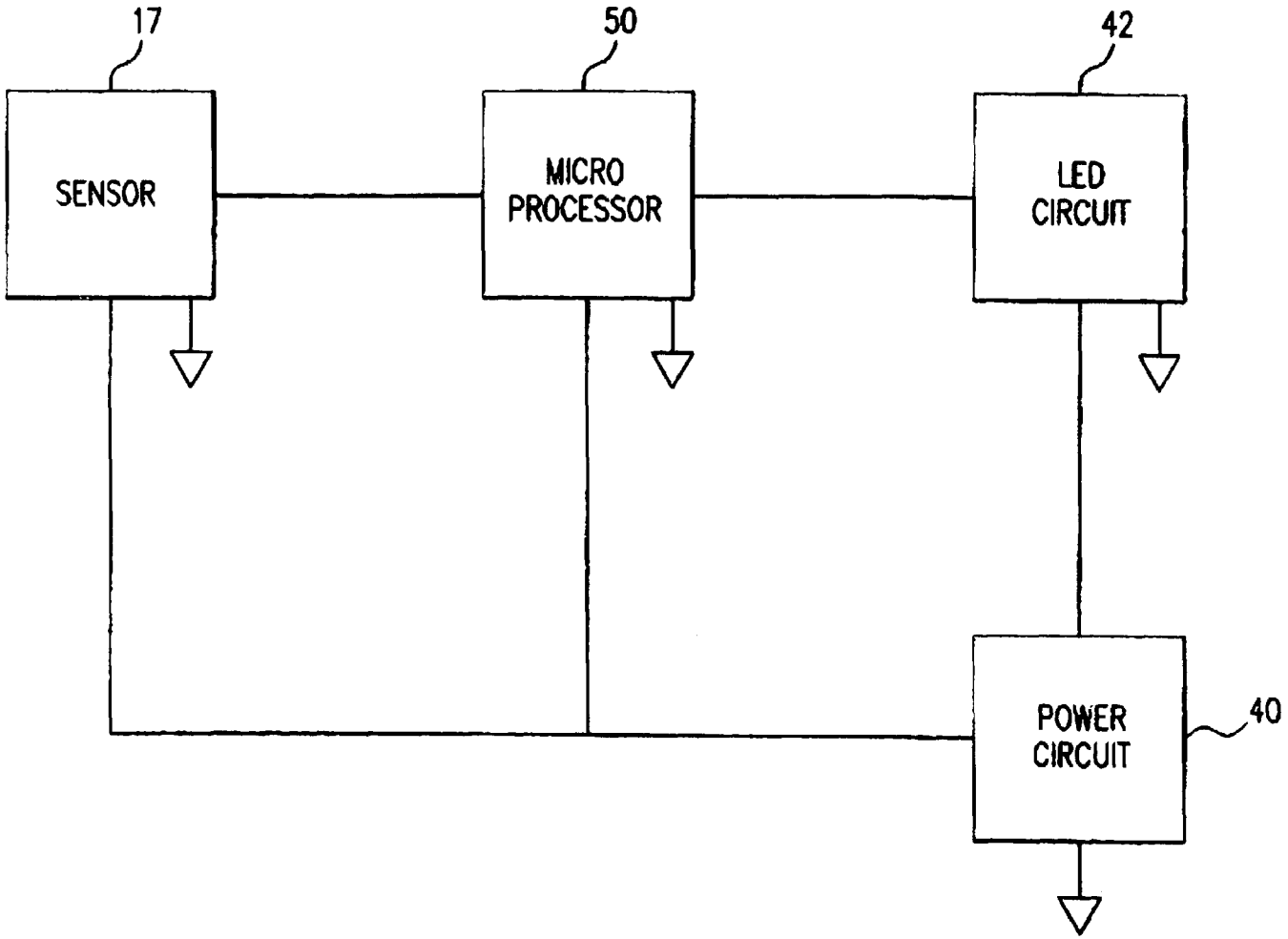
FIG. 7 shows a system level diagram of an embodiment of the present invention including a microprocessor.

FIG. 7 shows a system level diagram of an embodiment of the present invention. A power supply circuit is operably connected to, and supplies power to, sensor 17, a LED circuit 42 capable of emitting light, and microprocessor 50. Microprocessor 50 is operably connected to LED circuit 42 such that microprocessor 50 can control whether current is flowing through LED circuit 42 and hence whether LED circuit 42 emits light, and preferably the intensity of the current and emitted light as well. Sensor 17 is operably connected to microprocessor 50 such that sensor 17 can send a signal to microprocessor 50 in response to stimulus from a user. Microprocessor 50 may be programmed to turn LED circuit 42 on and off and vary the intensity of light emitted, incorporating input from sensor 17. Multiple sensors 17 may provide input to microprocessor 50, and multiple LED circuits 42 may be controlled by microprocessor 50.

Figure 8:
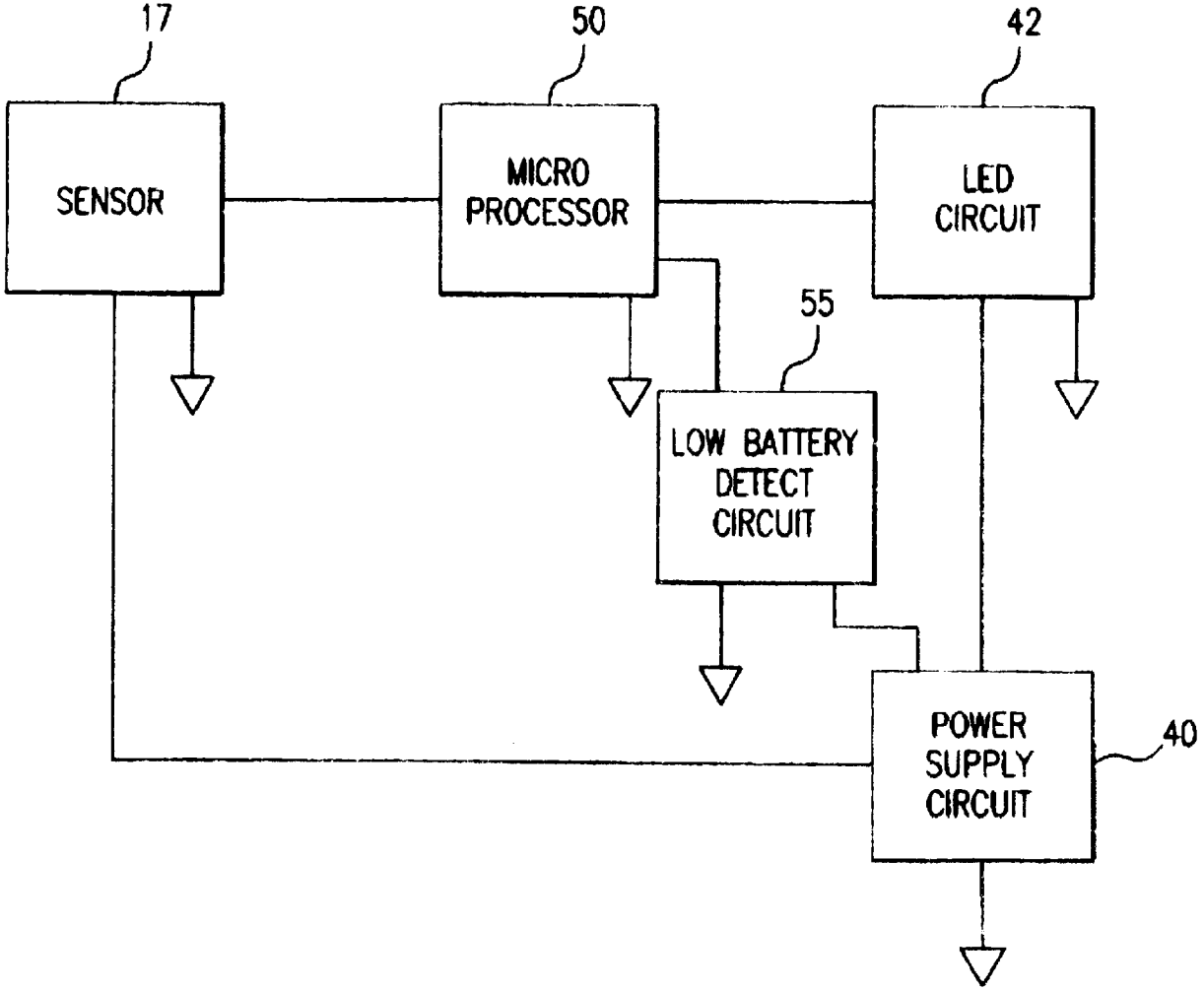
FIG. 8 shows a system level diagram of an embodiment of the present invention including a low battery detect circuit.

FIG. 8 shows a system level diagram of an embodiment of the present invention having a low battery detect circuit 55. Low battery detect circuit 55 is operably connected to power circuit 40 and microprocessor 50. Low battery detect circuit 55 sends a signal to microprocessor 50 when power circuit 40 is powered by a battery and the battery is running low. Microprocessor 50 may be programmed to light one or more LEDs 14 when the battery is running low. For example, microprocessor may be programmed to cause LED 14*a* to flash for one second each five second interval when the battery is running low, providing the user with advance notice that the battery needs to be changed.

Figure 9:
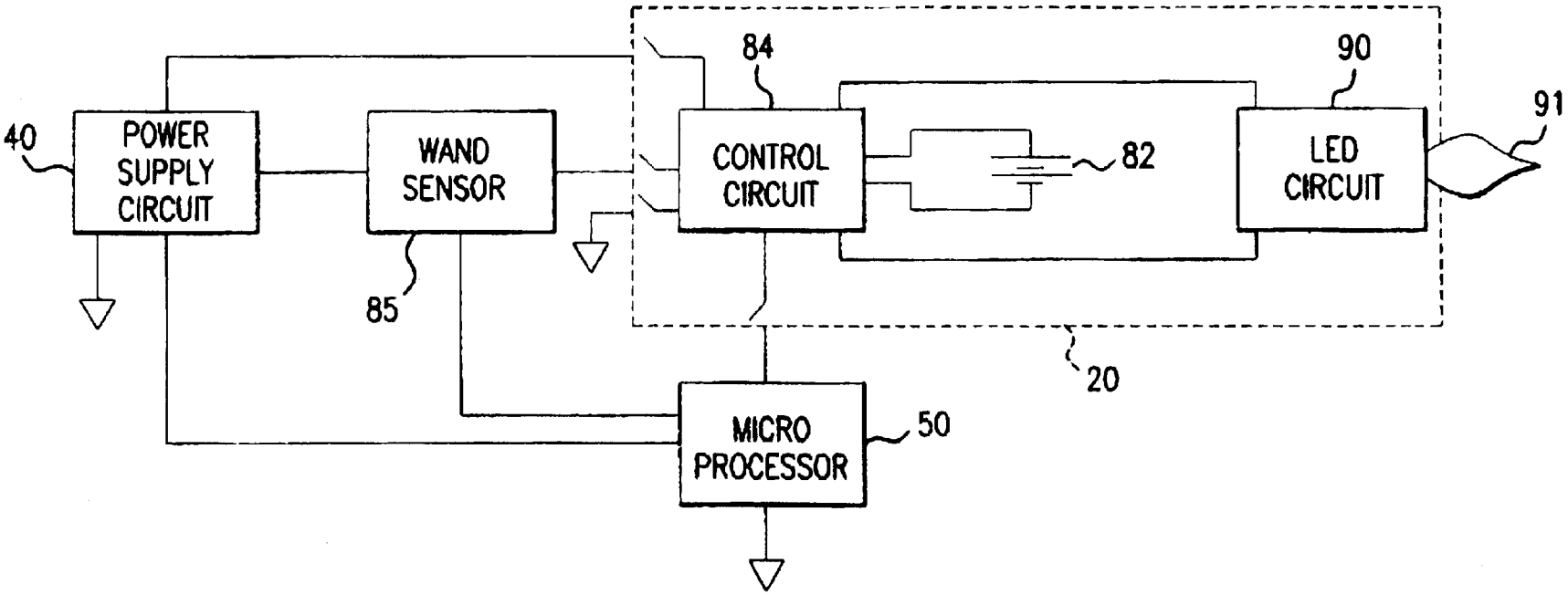
FIG. 9 shows a system level diagram of an embodiment of the present invention including a removable wand.

FIG. 9 shows a system level diagram of an embodiment of the present invention that corresponds to the embodiment of FIG. 2. In this embodiment, most of electronic circuitry 18 is as described in the embodiment of FIG. 5 and accompanying text. However, wand 20, which is removable, contains a control circuit 84 operably connected to power source 82 and wand LED circuit 90, which has a wand LED 91. When wand 20 is disposed within recess 24, control circuit 84 is operably connected to microprocessor 50, wand sensor 85 and power supply circuit 40. Control circuit 84 detects when wand 20 is removed from recess 24, and provides power from power source 82 to wand LED circuit 90 such that wand LED 91 is lit while wand 20 is removed from recess 24. Control circuit 84 also detects when wand 20 is placed back into recess 24, at which time control circuit 84 controls wand LED circuit 90 in response to input from microprocessor 50. Power source 82 may be a rechargeable power source, such as a capacitor or a rechargeable battery, in which case control circuit 84 preferably recharges power source 82 when wand 20 is in recess 24, using power drawn from power supply circuit 40. Wand sensor 85, which remains in menorah 10, detects when wand 20 is removed from recess 24 and when wand 20 is placed back into recess 24, and sends signals to microprocessor 50 accordingly. Microprocessor 50 is preferably programmed such that LEDs 14*b* through 14*i* may only be lit after wand 20 has been removed from recess 24, i.e., after wand LED 91 has been lit. Microprocessor 50 is preferably programmed to keep wand LED 91 lit after wand 20 has been placed back into recess 24. User input circuit 75, as shown in FIG. 4, may be a mechanical switch that sends a signal to microprocessor 50, and microprocessor 50 may be programmed to turn off all LEDs 14 in response to a signal from user input circuit 75, or after a predetermined period of time has passed.

What is claimed is:

1. An ornament, configured to represent a selected series of candle flames, comprising:

a. a power supply circuit;

b. a plurality of light-emitting circuits, each light-emitting circuit further comprising:

i. a light source adapted to represent a flame operably connected to said power supply circuit; and ii. a sensor operably connected to said light source capable receiving external magnetic stimulus from a user and controlling whether said light source emits light in response to said external magnetic stimulus, wherein each sensor is operable independently from sensors in other light-emitting circuits;

c. a magnet attached to a wand, adapted to provide the magnetic stimulus when the magnet is placed in proximity to the sensor.

2. The ornament of claim 1, wherein said sensor is a Hall effect sensor and said external stimulus is provided by proximity to a magnet.

3. The ornament of claim 1, wherein said ornament is a menorah having nine light-emitting circuits.

4. The ornament of claim 1, wherein said ornament is a kinara having seven light-emitting circuits.

5. The ornament of claim 1, further comprising a timing circuit operably connected between said power supply circuit and said light sources capable of interrupting the flow of current to said light sources after one of said light sources has been on for a predetermined period of time.

6. The ornament of claim 1, further comprising a blocking circuit operably connected between said power circuit and at least one, but not all, of said light sources, capable of blocking the flow of current to some of said light sources unless a particular light source is on.

7. The ornament of claim 1, wherein said light source is a LED.

8. An ornament, comprising:

a. a power supply circuit;

b. a light-emitting circuit operably connected to said power supply circuit and having a light source;

c. a magnetic sensor operably connected to said power supply circuit and capable of sending a first signal in response to external magnetic stimulus;

d. a microprocessor, operably connected to said sensor and capable of receiving said first signal, and operably connected to said light-emitting circuit and capable of controlling whether said light source of said light-emitting circuit emits light; and e. a magnet attached to a wand, adapted to provide the magnetic stimulus when the magnet is placed in proximity to the sensor.

9. The ornament of claim 8, wherein said ornament is a menorah having nine of said light-emitting circuits, each having a light source, and nine of said sensors, one sensor corresponding to each light source, and said microprocessor is programmed to turn on each of said light sources in response to receiving a first signal from said sensor corresponding to said light source.

10. The ornament of claim 8, wherein said sensor is a Hall-effect sensor and said external stimulus is provided by proximity to a magnet.

11. The ornament of claim 8, wherein said light source is a LED.

12. The ornament of claim 8, further comprising:

e. a Hall power controller operably connected between said power supply circuit and said sensor and also operably connected to said microprocessor, capable of controlling when power is transmitted from said power supply circuit to said sensors in response to a second signal sent from said microprocessor to said Hall power controller.

13. The ornament of claim 8, wherein said microprocessor is programmed to turn off said light sources if a predetermined period of time elapses during which said light sources are emitting light.

14. The ornament of claim 8, wherein said microprocessor is programmed to turn off said light sources in response to a predetermined pattern of signals from said sensors.

15. The ornament of claim 8, further comprising:

e. an AC/DC power detector operably connected to said power supply circuit and said microprocessor, capable of sending a third signal to said microprocessor, wherein the content of said third signal depends on whether said power supply circuit provides alternating current or direct current, and f. wherein the program run by said microprocessor depends upon the content of said third signal.

16. The ornament of claim 8, wherein said microprocessor is programmed to vary the light emitted by said light sources to simulate the flickering of a candle flame.

17. The ornament of claim 8, wherein said microprocessor is programmed to slowly increase the intensity of light emitted by said light sources after said first signal is received.

18. The ornament of claim 8, wherein said microprocessor is programmed to slowly decrease the intensity of light emitted by said light sources when said light sources are turned off.

19. The ornament of claim 9, wherein said microprocessor is programmed such that it will not turn on certain of said light sources unless certain other light sources have already been turned on.

20. The ornament of claim 8, further comprising a jumper operably connected to said microprocessor, wherein the program run by said microprocessor depends upon whether said jumper is opened or closed.

21. An ornament, configured to represent a selected series of candle flames, comprising:

a. a power supply circuit;

b. a plurality of light-emitting circuits, each light-emitting circuit further comprising:

i. a light source adapted to represent a flame operably connected to said power supply circuit; and ii. a sensor operably connected to said light source capable receiving external stimulus from a user and controlling whether said light source emits light in response to said external stimulus, wherein each sensor is operable independently from sensors in other light-emitting circuits;

c. a blocking circuit operably connected between said power supply circuit and at least one, but not all, of said light sources, capable of blocking the flow of current to some of said light sources unless a particular light source is on.

22. The ornament of claim 21, wherein said sensors are magnetic switches and said external stimulus is provided by the proximity to a magnet to said sensor.

23. The ornament of claim 21, wherein said sensors are touch plates.

24. The ornament of claim 21, wherein said ornament is a menorah having nine light-emitting circuits.

25. The ornament of claim 21, further comprising a timing circuit operably connected between said power supply circuit and said light-emitting circuits capable of interrupting the flow of current to said light sources after one of said light sources has been on for a predetermined period of time.

26. The ornament of claim 21, wherein said light sources are LEDs.

27. An ornament, comprising:

a. a power supply circuit;

b. a plurality of light-emitting circuits operably connected to said power supply circuit, each of the light-emitting circuits having a light source and an associated sensor capable of sending a signal in response to external stimulus; and c. a microprocessor, operably connected to said plurality of light-emitting circuits and associated sensors, adapted to receive the signals from the sensors and to control whether the light sources are on, and programmed to turn on a second of the light sources in response to a signal from the sensor associated with the second light source, provided that a first of the light sources has already been turned on.

28. The ornament of claim 27, wherein said ornament is a menorah having nine of said light-emitting circuits, each having a light source, and nine of said sensors, one sensor corresponding to each light source, and said microprocessor is programmed to turn on each of said light sources in response to receiving a first signal from said sensor corresponding to said light source.

29. The ornament of claim 27, wherein said sensor is a magnetic sensor and said external stimulus is provided by proximity to a magnet.

30. The ornament of claim 27, wherein said sensor is a photo sensor and said external stimulus is provided by proximity to a light source.

31. The ornament of claim 27, further comprising:

d. a Hall power controller operably connected between said power supply circuit and said sensor and also operably connected to said microprocessor, capable of controlling when power is transmitted from said power supply circuit to said sensors in response to a second signal sent from said microprocessor to said Hall power controller.

32. The ornament of claim 27, wherein said microprocessor is programmed to turn off said light sources if a predetermined period of time elapses during which said light sources are emitting light.

33. The ornament of claim 27, wherein said microprocessor is programmed to turn off said light sources in response to a predetermined pattern of signals from said sensor.

34. The ornament of claim 27, further comprising:

d. an AC/DC power detector operably connected to said power supply circuit and said microprocessor, capable of sending a third signal to said microprocessor, wherein the content of said third signal depends on whether said power supply circuit provides alternating current or direct current, and e. wherein the program run by said microprocessor depends upon the content of said third signal.

35. The ornament of claim 27, wherein said microprocessor is programmed to vary the light emitted by said light sources to simulate the flickering of a candle flame.

36. The ornament of claim 27, wherein said microprocessor is programmed to slowly increase the intensity of light emitted by said light source after said first signal is received.

37. The ornament of claim 27, wherein said microprocessor is programmed to slowly decrease the intensity of light emitted by said light sources when said light sources are turned off.

38. The ornament of claim 27, further comprising a jumper operably connected to said microprocessor, wherein the program run by said microprocessor depends upon whether said jumper is opened or closed.

39. The ornament of claim 27, wherein said microprocessor is programmed such that all of the light sources can be lit only in a predetermined order.

40. The ornament of claim 27, wherein said light sources are LEDs.

* * * * *

UNITED STATES PATENT AND TRADEMARK OFFICE

CERTIFICATE OF CORRECTION

PATENT NO : 6,053,622

DATED : 12/20/2000

INVENTOR(S) : Horowitz et al.

It is certified that error appears in the above-identified patent and that said Letters Patent are hereby corrected as shown below:

| Column | Line | Change from: | Change to: |
|---|---|---|---|
| 9 | 53 | capable receiving | capable of receiving |
| 11 | 38 | proximity to | proximity of |

Signed and Sealed this

Twenty-second Day of May, 2001

*Attest:*

Nicholas P. Godici

NICHOLAS P. GODICI

*Attesting Officer*

*Acting Director of the United States Patent and Trademark Office*